US011269367B2

(12) United States Patent
Sano

(10) Patent No.: US 11,269,367 B2
(45) Date of Patent: Mar. 8, 2022

(54) VOLTAGE REGULATOR

(71) Applicant: Seiko Epson Corporation, Tokyo (JP)

(72) Inventor: Yusuke Sano, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/024,861

(22) Filed: Sep. 18, 2020

(65) Prior Publication Data

US 2021/0089069 A1 Mar. 25, 2021

(30) Foreign Application Priority Data

Sep. 19, 2019 (JP) ..... JP2019-170229

(51) Int. Cl.
*G05F 1/575* (2006.01)
*G05F 1/59* (2006.01)

(52) U.S. Cl.
CPC ..... *G05F 1/575* (2013.01); *G05F 1/59* (2013.01)

(58) Field of Classification Search
CPC ..... G05F 1/575; G05F 1/59
See application file for complete search history.

(56) References Cited

U.S. PATENT DOCUMENTS 11,099,589 B1 * 8/2021 Laur ..... G05F 1/565
2015/0171731 A1 6/2015 Tomioka et al.
2018/0173260 A1 * 6/2018 Zou ..... G05F 1/575
2019/0243401 A1 * 8/2019 Yasusaka ..... G05F 1/565
2021/0194346 A1 * 6/2021 Phogat ..... G05F 1/575
2021/0200252 A1 * 7/2021 Wang ..... G05F 1/565

FOREIGN PATENT DOCUMENTS

JP 2015-118452 A 6/2015

* cited by examiner

*Primary Examiner* — Kyle J Moody
*Assistant Examiner* — Lakaisha Jackson
(74) *Attorney, Agent, or Firm* — Harness, Dickey & Pierce, P.L.C.

(57) ABSTRACT

A voltage regulator that outputs, from an output terminal, as an output voltage, a power supply voltage that is input from an input terminal, the voltage regulator including an error amplifier that includes a constant current source that causes a current that is based on a constant current supplied from an outside to flow, and outputs a signal that is based on a difference between a feedback voltage obtained by dividing the output voltage and a reference voltage, an output transistor that has a source connected to the input terminal, a drain connected to the output terminal, and a gate connected to an output of the error amplifier, a capacitor that has one end connected to the output terminal, a boost transistor that is connected in parallel with the constant current source and that has a gate connected to another end of the capacitor, and a diode that has an anode connected to the other end of the capacitor and a cathode connected to a ground terminal.

3 Claims, 6 Drawing Sheets

VOLTAGE REGULATOR

The present application is based on, and claims priority from JP Application Serial Number 2019-170229, filed Sep. 19, 2019, the disclosure of which is hereby incorporated by reference herein in its entirety.

BACKGROUND

1. Technical Field

The present disclosure relates to a voltage regulator.

2. Related Art

Heretofore, in a circuit that can improve responsiveness of a voltage regulator by causing a boost current to additionally flow through an error amplifier, when an output of the voltage regulator suddenly fluctuates, and reduce a peak value of the fluctuation in the output, for example, as described in JP-A-2015-118452, a method for setting an upper limit value of the boost current by using a constant current and a current mirror circuit is known.

However, in the voltage regulator described in JP-A-2015-118452, there is a problem in that, since, in a use state, a constant current always flows through three paths, namely, a path for supplying a current to the error amplifier, a current path for a filter that handles minute changes in the output, and a current path for limiting the upper limit of the boost current, it is difficult to reduce the current consumption in some cases.

SUMMARY

The voltage regulator according to the present application is a voltage regulator that outputs, from an output terminal, as an output voltage, a power supply voltage that is input from an input terminal, the voltage regulator including an error amplifier that includes a constant current source that causes a current that is based on a constant current supplied from an outside to flow, and outputs a signal that is based on a difference between a feedback voltage obtained by dividing the output voltage and a reference voltage, an output transistor that has a source connected to the input terminal, a drain connected to the output terminal, and a gate connected to an output of the error amplifier, a capacitor that has one end connected to the output terminal, a boost transistor that is connected in parallel with the constant current source and that has a gate connected to another end of the capacitor, and a diode that has an anode connected to the other end of the capacitor and a cathode connected to a ground terminal.

The above-described voltage regulator may include a constant current driving transistor that forms a current mirror with the boost transistor and drives the boost transistor by a constant current, and the size of the constant current driving transistor may be smaller than the size of the boost transistor.

The above-described voltage regulator may include a resistor that has one end connected to the output terminal, a capacitor that is separate from the capacitor and is connected between the other end of the resistor and the ground terminal, a first transistor that is provided between the boost transistor and the ground terminal and has a gate connected to the other end of the resistor, and a second transistor that is provided between the constant current driving transistor and the ground terminal and that has a gate connected to the other end of the resistor.

BRIEF DESCRIPTION OF THE DRAWINGS

The disclosure will be described with reference to the accompanying drawings, wherein like numbers reference like elements.

DESCRIPTION OF EXEMPLARY EMBODIMENTS

1. First Embodiment

Figure 1:
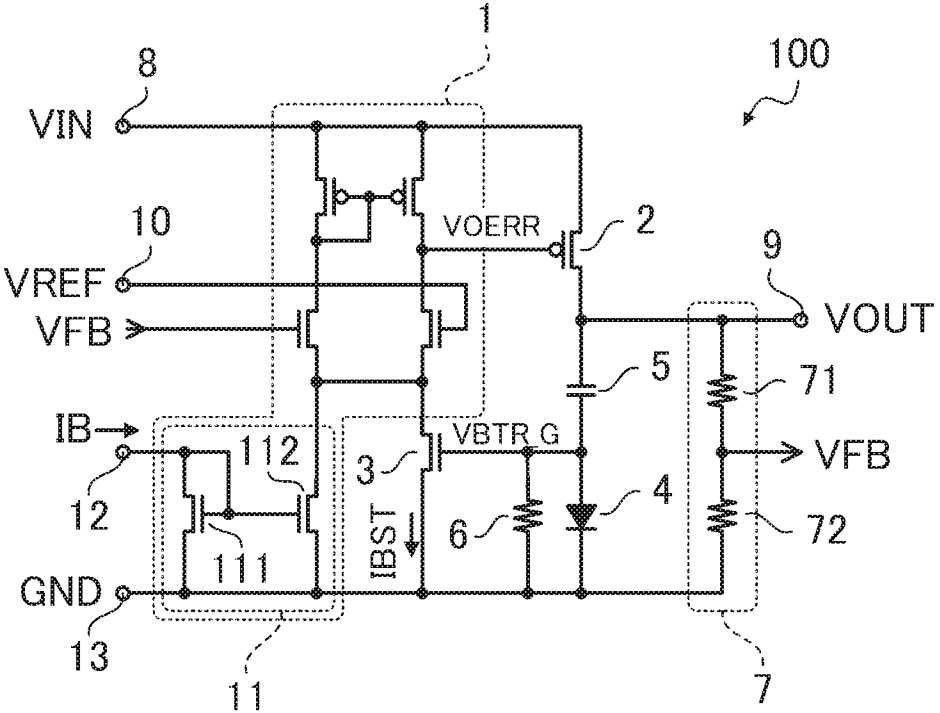
FIG. 1 is a circuit diagram of a voltage regulator according to a first embodiment.

FIG. 1 is a circuit diagram of a voltage regulator according to the first embodiment.

First, a schematic configuration of the voltage regulator 100 according to the first embodiment will be described.

The voltage regulator 100 is constituted of an error amplifier 1, an output transistor 2, a boost transistor 3, a diode 4, a capacitor 5, a resistor 6, a voltage-dividing circuit 7, an input terminal 8, an output terminal 9, a reference voltage input terminal 10, a reference current input terminal 12, a ground terminal 13, and the like. A power supply voltage VIN of the voltage regulator 100 is input from the input terminal 8. A constant current IB is input to the reference current input terminal 12 from outside.

The error amplifier 1 obtains an error between a feedback voltage VFB obtained by an output voltage VOUT that is the voltage at the output terminal 9 being divided by the voltage-dividing circuit 7 and a reference voltage VREF that is input from the reference voltage input terminal 10, and generates and outputs an error voltage VOERR that is a signal corresponding to that error. The error amplifier 1 includes a constant current source 11, and the constant current source 11 causes a current that corresponds to the constant current IB input from the reference current input terminal 12 to flow through the error amplifier 1.

The constant current source 11 is constituted of a transistor 111, a transistor 112, and the like, and the drain and the gate of the transistor 111 are connected to the reference current input terminal 12, and the source of the transistor 111 is connected to the ground terminal 13. The drain of the transistor 112 is connected to the source side of transistors that form a differential pair of the above-described error amplifier 1, the source of the transistor 112 is connected to the ground terminal 13, and the gate of transistor 112 is connected to the reference current input terminal 12. The transistor 111 and the transistor 112 are in a current mirror configuration.

In the output transistor 2, the source is connected to the input terminal 8, the drain is connected to the output terminal 9, and the gate is connected to the output of the error amplifier 1. The conduction of the output transistor 2 is controlled by the error voltage VOERR that is the output of the error amplifier 1, and accordingly, a current output from the output terminal 9 is controlled, and the output voltage VOUT is kept constant.

As shown in FIG. 1, in the boost transistor 3, the drain is connected to the source side of the transistors that form the differential pair included in the error amplifier 1, the source is connected to the ground terminal 13, and the gate is connected to the anode of a diode 4, which will be described later. In other words, the boost transistor 3 is connected in parallel with the constant current source 11. When a sudden increase in the output voltage VOUT occurs, this boost transistor 3 causes a current that corresponds to the increased amount of the output voltage VOUT to additionally flow through the error amplifier 1 as the boost current IBST. Since the total amount of the current flowing through the error amplifier 1 increases, the error amplifier 1 starts to operate at a higher speed. As a result, conduction control of the output transistor 2 is performed at a higher speed in response to the increase in the output, and therefore it is possible to suppress the peak value of the sudden increase in the output voltage VOUT.

In the diode 4, the anode is connected to the gate of the boost transistor 3, and the cathode is connected to the ground terminal 13. When the output voltage VOUT significantly increases, this diode 4 limits the voltage such that the gate voltage VBTR_G of the boost transistor 3 does not exceed the forward voltage of the diode.

In the capacitor 5, one end is connected to the output terminal 9, and the other end is connected to the gate terminal of the boost transistor 3. The capacitor 5 boosts the gate voltage VBTR_G of the boost transistor 3 that is connected to the other end when the output voltage VOUT suddenly increases.

The resistor 6 is connected in parallel with the diode 4. When the output voltage VOUT is stable, the same voltage GND as the ground terminal 13 is supplied to the gate of the boost transistor 3 via the resistor 6.

The voltage-dividing circuit 7 is constituted of a resistor 71, a resistor 72, and the like, and is connected in series between the output terminal 9 and the ground terminal 13. The output voltage VOUT is divided by the resistance ratio of the resistor 71 and the resistor 72, output as a feedback voltage VFB, and input to the error amplifier 1.

Figure 2:
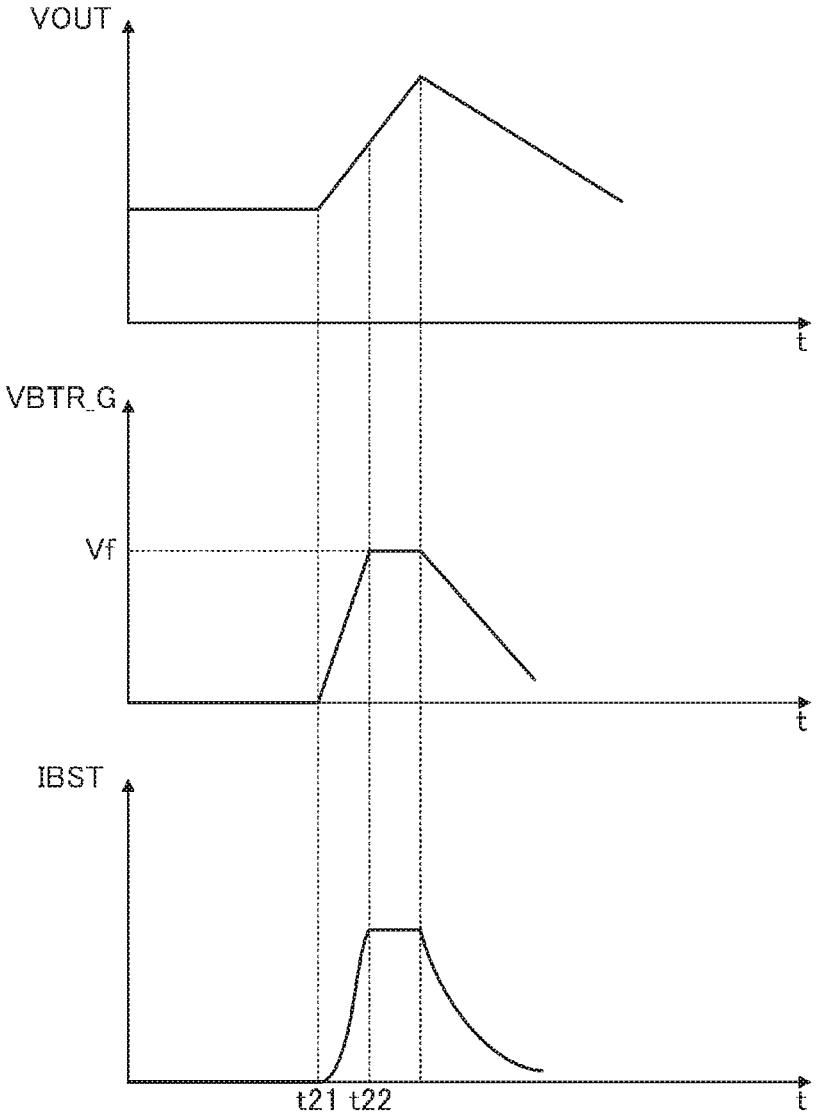
FIG. 2 illustrates waveform charts showing examples of waveforms of units of the voltage regulator according to the first embodiment at the time of a fluctuation of an output voltage.

FIG. 2 illustrates waveform charts showing examples of waveforms of the units of the voltage regulator 100 when the output voltage VOUT suddenly increases.

Hereinafter, the operations at the time of a sudden increase in the output performed by the voltage regulator 100 will be described with reference to FIG. 2. In a steady state, in other words, when the output voltage VOUT is stable and the expected voltage is output, the gate voltage VBTR_G of the boost transistor 3 is the same as the voltage GND at the ground terminal 13 via the resistor 6, and therefore the boost current IBST does not flow therethrough. When the output voltage VOUT suddenly increases at time t21 shown in FIG. 2, the gate voltage VBTR_G of the boost transistor 3 is also increased by the capacitor 5 in accordance with the increase in the output voltage VOUT, and the boost current IBST additionally flows through the error amplifier 1. As at time point t22 shown in FIG. 2, when the output voltage VOUT significantly increases and the gate voltage VBTR_G of the boost transistor 3 reaches a forward voltage Vf of the diode 4, the current flows toward the ground terminal 13 via the diode 4, and therefore, the gate voltage VBTR_G of the boost transistor 3 is limited to the forward voltage Vf of the diode 4, and the boost current IBST is also limited. Accordingly, it is possible to achieve suppression such that a current does not excessively flow through the error amplifier 1.

According to the present embodiment, the following effects can be obtained.

By limiting the upper limit of the gate voltage VBTR_G of the boost transistor 3 by using the diode 4, it is possible to suppress the peak value of the boost current IBST that flows through the boost transistor 3. In the circuit in which a current that flows through the boost transistor 3 is limited by the diode 4, there is no current path in which a current constantly flows, and therefore such a circuit can be substituted for one of the current paths shown in JP-A-2015-118452, and current consumption can be suppressed.

Note that the voltage regulator 100 need not include the resistor 6.

Even if the voltage regulator 100 does not include the resistor 6, the upper limit of the gate voltage VBTR_G of the boost transistor 3 is limited by the diode 4, the peak value of the boost current IBST that flows through the boost transistor 3 can be suppressed, and no current constantly flows through the circuit that suppresses the peak value of the boost current IBST that flows through the boost transistor 3.

2. Second Embodiment

Figure 3:
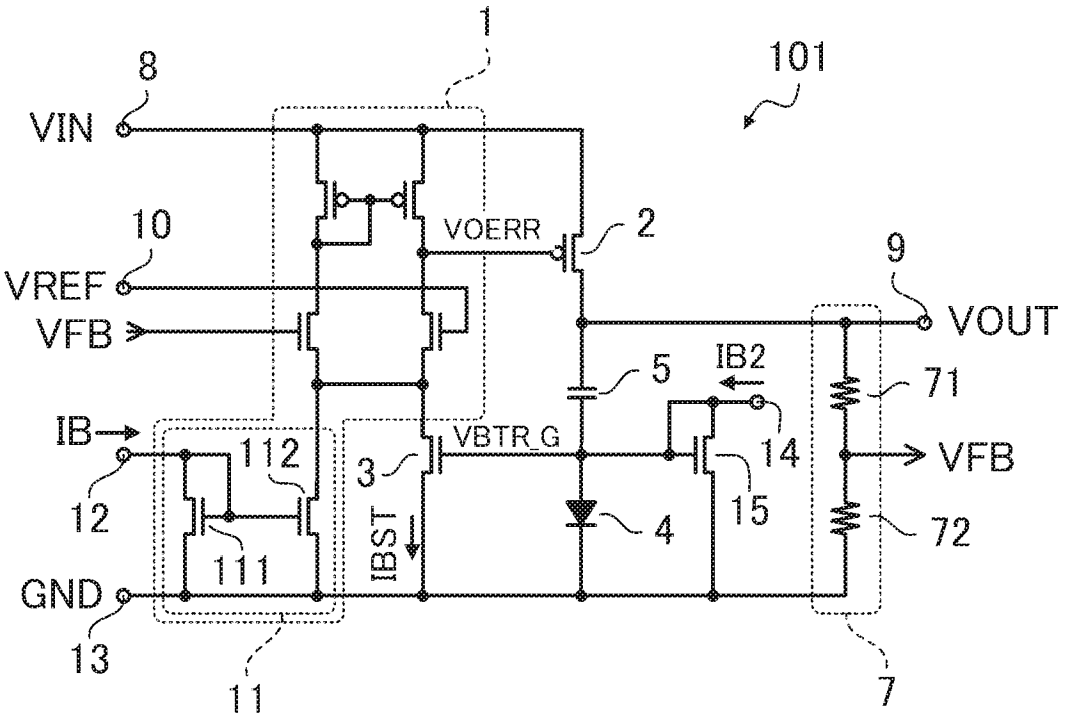
FIG. 3 is a circuit diagram of a voltage regulator according to a second embodiment.

FIG. 3 is a circuit diagram of the voltage regulator according to a second embodiment.

Hereinafter, a schematic configuration of the voltage regulator 101 according to the second embodiment will be described.

The voltage regulator 101 is constituted of the error amplifier 1, the output transistor 2, the boost transistor 3, the diode 4, the capacitor 5, the voltage-dividing circuit 7, the input terminal 8, the output terminal 9, the reference voltage input terminal 10, the reference current input terminal 12, the ground terminal 13, a constant current input terminal 14, a constant current driving transistor 15, and the like. A power supply voltage VIN of the voltage regulator 101 is input from the input terminal 8. A constant current IB is input to the reference current input terminal 12 from outside.

In the constant current driving transistor 15, the drain and gate are connected to the constant current input terminal 14, and the source is connected to the ground terminal 13. The constant current input terminal 14 is connected to the gate of the boost transistor 3, and the constant current driving transistor 15 and the boost transistor 3 are in a current mirror configuration. In other words, the constant current driving transistor 15 drives the boost transistor 3 by a constant current IB2 that is supplied to the constant current input terminal 14.

When the constant current IB2 is supplied to the constant current input terminal 14, a current flows through the constant current driving transistor 15, and therefore the gate voltage VBTR_G of the boost transistor 3 in a steady state becomes higher than that of the first embodiment. As a result, in contrast to the first embodiment, the gate voltage VBTR_G of the boost transistor 3 is offset in the second embodiment. In this state, when the output voltage VOUT increases, the boost current IBST increases more rapidly than that of the first embodiment, and therefore the error amplifier 1 responds to the change in the output voltage VOUT more quickly than that of the first embodiment. Accordingly, the peak value of the sudden increase in the output voltage VOUT can be further suppressed. Furthermore, due to the size, specifically the gate width, of the constant current driving transistor 15 being smaller than the gate width of the boost transistor 3, given a fixed amount of current that flows through the boost transistor 3, the current that flows through the constant current driving transistor 15 is minimized.

Figure 4:
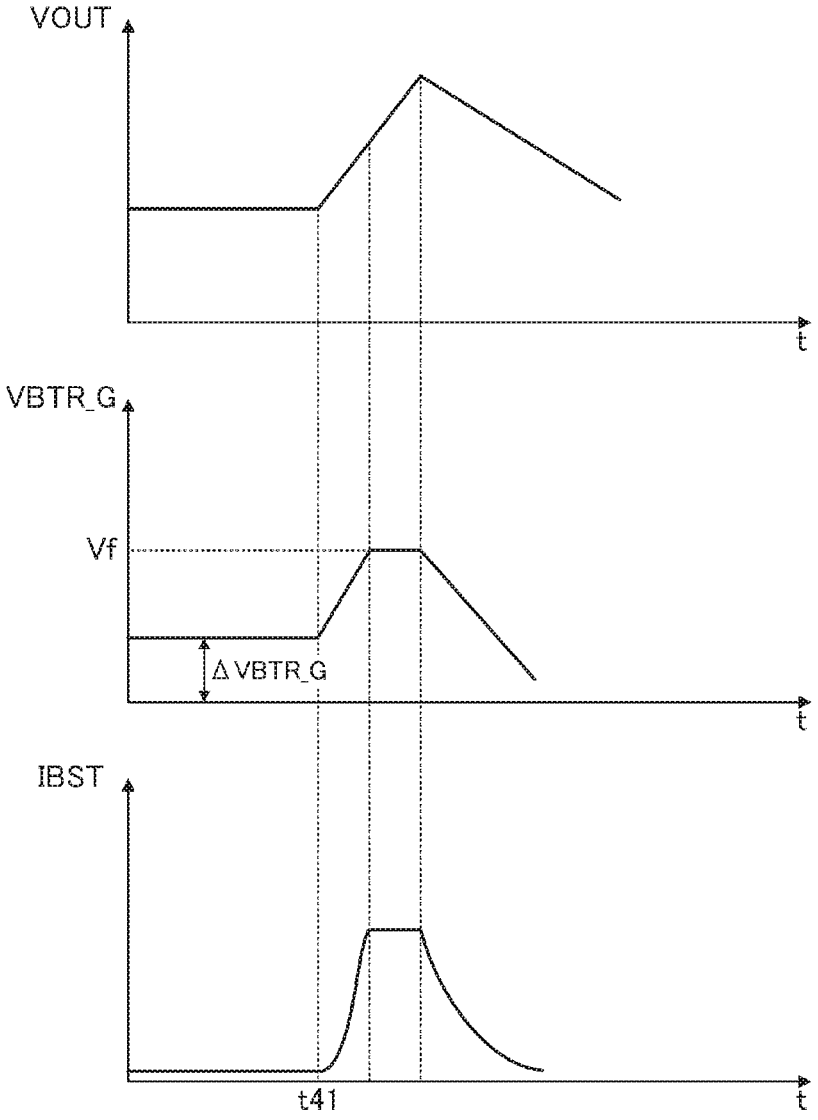
FIG. 4 illustrates waveform charts showing examples of waveforms of units of the voltage regulator according to the second embodiment at the time of fluctuation of an output voltage.

FIG. 4 illustrates waveform charts showing examples of waveforms of the units of the voltage regulator 101 when the output voltage VOUT suddenly increases.

Hereinafter, the operations at the time of a sudden increase in the output of the voltage regulator 101 will be described with reference to FIG. 4. In a steady state, in other words, a state in which the output voltage VOUT is stable and the expected voltage is output, when the constant current IB2 is input from the constant current input terminal 14, the input constant current IB2 flows through the constant current driving transistor 15. When the constant current flows through the constant current driving transistor 15, a potential Δ VBTR_G corresponding to the flowing constant current IB2 is applied to the gate of the boost transistor 3. When the output voltage VOUT suddenly increases at time t41 shown in FIG. 4, the gate voltage VBTR_G of the boost transistor 3 is increased by the increased amount of the output voltage VOUT by the capacitor 5, and the boost current IBST additionally flows through the error amplifier 1. Since the gate voltage VBTR_G of the boost transistor 3 in the steady state is higher than that of the first embodiment, given the same boost amount of the potential, more boost current IBST can flow more rapidly in the second embodiment. This makes it possible to reduce the peak voltage of the increase in the output voltage VOUT. Similarly to the first embodiment, the upper limit value of the gate voltage VBTR_G of the boost transistor 3 is limited to the forward voltage of the diode 4, and therefore it is possible to prevent a case in which a current excessively flows through the error amplifier 1.

According to the present embodiment, the following effects can be obtained in addition to the effects of the first embodiment.

The provision of the constant current driving transistor 15 that forms a current mirror with the boost transistor 3 makes it possible to further reduce the peak value of the increase in the output voltage VOUT.

Furthermore, due to the gate width of the constant current driving transistor 15 being smaller than the gate width of the boost transistor 3, the amount of the constant current IB2 that flows in the steady state can be reduced, making it possible to reduce the current consumption of the voltage regulator 101.

3. Third Embodiment

Figure 5:
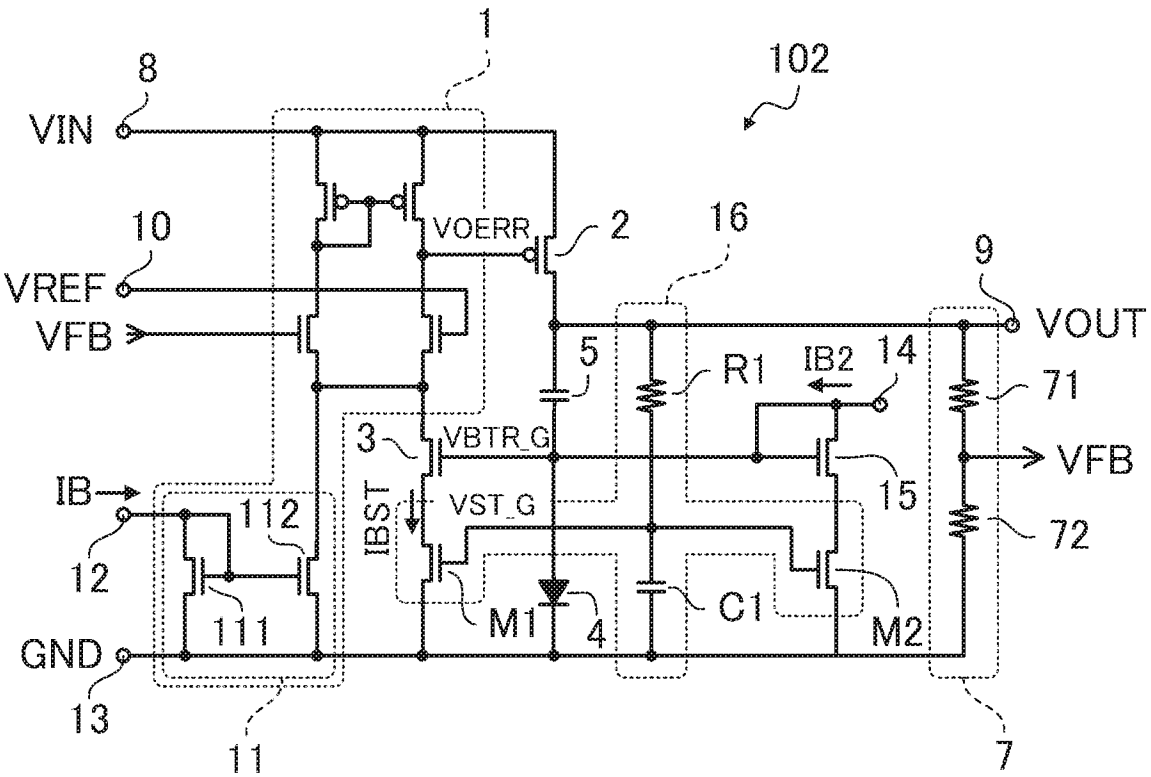
FIG. 5 is a circuit diagram of a voltage regulator according to a third embodiment.

FIG. 5 is a circuit diagram of a voltage regulator according to a third embodiment.

Hereinafter, a schematic configuration of a voltage regulator 102 according to the third embodiment will be described.

The voltage regulator 102 is constituted of the error amplifier 1, the output transistor 2, the boost transistor 3, the diode 4, the capacitor 5, the voltage-dividing circuit 7, the input terminal 8, the output terminal 9, the reference voltage input terminal 10, the reference current input terminal 12, the ground terminal 13, a constant current input terminal 14, a constant current driving transistor 15, a soft start circuit 16 and the like. A power supply voltage VIN of the voltage regulator 102 is input from the input terminal 8. A constant current IB is input to a reference current input terminal 12 from outside.

The soft start circuit 16 is constituted of N-type MOS transistors M1 and M2, a resistor R1, a capacitor C1, and the like. Specifically, the soft start circuit 16 is provided with the resistor R1 that is a resistor having one end connected to the output terminal 9, the capacitor C1 that is separate from the capacitor 5 and is connected between the other end of the resistor R1 and the ground terminal 13, the transistor M1 serving as a first transistor that is provided between the boost transistor 3 and the ground terminal 13 and whose gate is connected to the other end of the resistor R1, and the transistor M2 serving as a second transistor that is provided between the constant current driving transistor 15 and the ground terminal 13 and whose gate is connected to the other end of the resister R1.

When the voltage regulator 102 is in the steady state and the output voltage VOUT of the voltage regulator exceeds the threshold values of the transistors M1 and M2, the gate voltage VST_G of the transistors M1 and M2 is the same as the output voltage VOUT supplied via the resistor R1, and therefore the transistors M1 and M2 enter a conduction state.

In contrast, during the start-up of the voltage regulator 102, since the gate voltage VST_G of the transistors M1 and M2 is delayed due to the resistor R1 and the capacitor C1, the gate voltage VST_G rises with a delay with respect to the rise of the output voltage VOUT. By controlling the rising time of the gate voltage of the transistors M1 and M2 using this delay, it is possible to bring the transistors M1 and M2 into a non-conduction state at the start-up timing.

Figure 6:
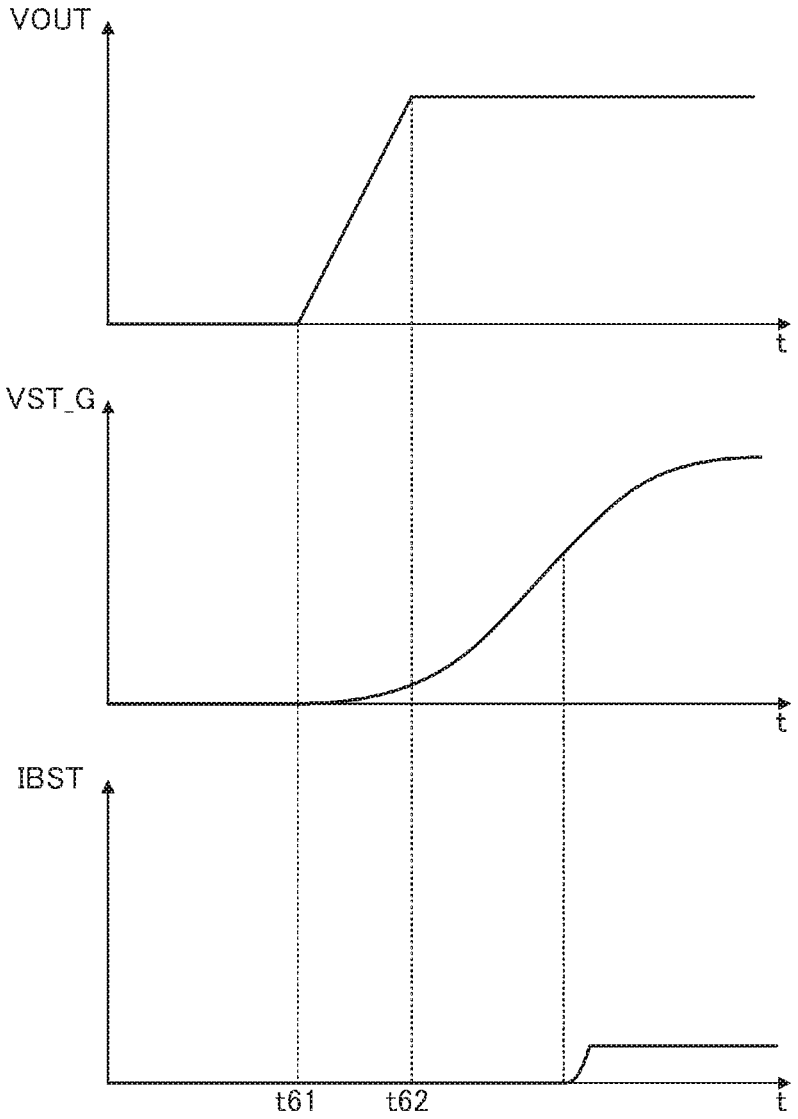
FIG. 6 illustrates waveform charts showing examples of waveforms of the units of the voltage regulator according to the third embodiment at the time of start-up.

FIG. 6 illustrates waveform charts showing examples of waveforms of units in the voltage regulator 102 at the start-up.

Now, the operations of the voltage regulator 102 during the start-up will be described with reference to FIG. 6. Before start-up of the voltage regulator 102, the output voltage VOUT is the same voltage GND as the ground terminal 13 via the voltage dividing circuit 7. The gate voltage VST_G of the transistors M1 and M2 is also the same voltage GND as the ground terminal 13 via the resistor R1. When the voltage regulator 102 is started at time t61 shown in FIG. 6, the voltage of the output voltage VOUT starts to rise. As this time, the gate voltage VBTR_G of the boost transistor 3 is boosted by the capacitor 5 in response to the rise of the output voltage VOUT, and the boost transistor 3 enters the conduction state. If the soft start circuit 16 is not provided, the boost current IBST from the boost transistor 3, which has entered the conduction state at the start-up, flows through the error amplifier 1, and thus the peak value of the current consumption at the start-up becomes high. In contrast, if the soft start circuit 16 is provided, the gate voltages of the transistors M1 and M2 are boosted while being affected by a delay due to the resistor R1 and the capacitor C1. At this time, when the rising time of the output voltage VOUT is t62, it is possible to start up the voltage regulator 102 without causing the boost current IBST supplied by the boost transistor 3 to flow through the error amplifier 1 by taking a longer time than the time period t62 to t61 to raise the gate voltage VST_G of the transistors M1 and M2 to the voltage at which the transistors M1 and M2 enter the conduction state.

According to the present embodiment, the following effects can be obtained in addition to the effects of the present embodiment 1.

Due to the transistors M1 and M2 entering the non-conduction state at the start-up of the voltage regulator 102, the boost transistor 3 no longer causes the boost current IBST to flow through the error amplifier 1, making it possible to reduce the peak value of the current consumption at the start-up of the circuit.

Note that, in the voltage regulator according to the above-mentioned first to third embodiments, a configuration is also possible in which, for example, the P-type and N-type of MOS transistors are interchanged with each other in order to lower the negative voltage, and the voltage regulator is configured accordingly.

Hereinafter, the contents derived from the embodiments will be described.

The voltage regulator according to the present application is a voltage regulator that outputs, from an output terminal, as an output voltage, a power supply voltage that is input from an input terminal, the voltage regulator including an error amplifier that includes a constant current source that causes a current that is based on a constant current supplied from an outside to flow, and outputs a signal that is based on a difference between a feedback voltage obtained by dividing the output voltage and a reference voltage, an output transistor that has a source connected to the input terminal, a drain connected to the output terminal, and a gate connected to an output of the error amplifier, a capacitor that has one end connected to the output terminal, a boost transistor that is connected in parallel with the constant current source and that has a gate connected to another end of the capacitor, and a diode that has an anode connected to the other end of the capacitor and a cathode connected to a ground terminal.

According to this configuration, the peak value of the boost current that flows through the boost transistor can be suppressed by suppressing the upper limit of the gate voltage of the boost transistor to the forward voltage of the diode. Since there is no current path through which a current constantly flows in the circuit that limits the current that flows through the boost transistor by using the diode, it is possible to eliminate the current path through which a current steadily flows for limiting the boost current. Accordingly, it is possible to supply a low current consumption voltage regulator that is provided with a boost current limit.

The above-described voltage regulator may include a constant current driving transistor that forms a current mirror with the boost transistor and drives the boost transistor by a constant current, and the size of the constant current driving transistor may be smaller than the size of the boost transistor.

According to this configuration, since offset can be added to the gate voltage of the boost transistor, the boost transistor responds quicker, and as a result, the effect that it is possible to further suppress the peak voltage value when the output voltage suddenly increases can be obtained. Furthermore, due to the gate width of the constant current driving transistor being smaller than the gate width of the boost transistor, given a fixed amount of the current that steadily flows through the boost transistor, it is possible to reduce the current that flows through the constant current driving transistor. Accordingly, the effect can be obtained that the response to the increase in the output voltage is quicker while the current consumption in the steady state is suppressed.

The above-described voltage regulator may include a resistor that has one end connected to the output terminal, a capacitor that is separate from the capacitor and is connected between the other end of the resistor and the ground terminal, a first transistor that is provided between the boost transistor and the ground terminal and has a gate connected to the other end of the resistor, and a second transistor that is provided between the constant current driving transistor and the ground terminal and that has a gate connected to the other end of the resistor.

According to this configuration, due to a delay due to a capacitor that is separate from the resister, no current flows through the boost transistor until the output voltage fully rises. Accordingly, the effect is obtained that the peak value of the current consumption at the start-up of the circuit is reduced.

What is claimed is:

1. A voltage regulator that outputs, from an output terminal, as an output voltage, a power supply voltage that is input from an input terminal, the voltage regulator comprising:

an error amplifier that includes a constant current source that causes a current that is based on a constant current supplied from an outside to flow, and outputs a signal that is based on a difference between a feedback voltage obtained by dividing the output voltage and a reference voltage;

an output transistor that has a source connected to the input terminal, a drain connected to the output terminal, and a gate connected to an output of the error amplifier;

a capacitor that has one end connected to the output terminal;

a boost transistor that is connected in parallel with the constant current source and that has a gate connected to another end of the capacitor; and a diode that has an anode connected to the other end of the capacitor and a cathode connected to a ground terminal.

2. The voltage regulator according to claim 1, further comprising:

a constant current driving transistor that forms a current mirror with the boost transistor and drives the boost transistor by a constant current, wherein the size of the constant current driving transistor is smaller than the size of the boost transistor.

3. The voltage regulator according to claim 2, further comprising:

a resistor that has one end connected to the output terminal;

a capacitor that is separate from the capacitor and is connected between the other end of the resistor and the ground terminal;

a first transistor that is provided between the boost transistor and the ground terminal and has a gate connected to the other end of the resistor; and a second transistor that is provided between the constant current driving transistor and the ground terminal and that has a gate connected to the other end of the resistor.

* * * * *